US008274391B2

(12) United States Patent
Yang

(10) Patent No.: US 8,274,391 B2
(45) Date of Patent: Sep. 25, 2012

(54) EAS TAG USING TAPE WITH CONDUCTIVE ELEMENT

(76) Inventor: Xiao Hui Yang, Los Altos, CA (US)

( * ) Notice: Subject to any disclaimer, the term of this patent is extended or adjusted under 35 U.S.C. 154(b) by 600 days.

(21) Appl. No.: 12/498,367

(22) Filed: Jul. 7, 2009

(65) Prior Publication Data

US 2009/0289798 A1 Nov. 26, 2009

Related U.S. Application Data

(63) Continuation-in-part of application No. 12/391,222, filed on Feb. 23, 2009.

(60) Provisional application No. 61/030,932, filed on Feb. 22, 2008, provisional application No. 61/030,929, filed on Feb. 22, 2008.

(51) Int. Cl.
*G08B 13/14* (2006.01)

(52) U.S. Cl. ..... 340/572.8; 340/572.1; 340/10.1

(58) Field of Classification Search ..... 340/505, 340/572, 10

See application file for complete search history.

(56) References Cited

U.S. PATENT DOCUMENTS

| | | | |
|---|---|---|---|
| 5,794,464 | A | 8/1998 | Yeager et al. |
| 5,955,951 | A | 9/1999 | Wischerop et al. |
| 6,092,401 | A | 7/2000 | Sankey et al. |
| 6,237,375 | B1 | 5/2001 | Wymer |
| 7,162,899 | B2 | 1/2007 | Fawcett et al. |
| 7,168,275 | B2 | 1/2007 | Fawcett et al. |
| 7,190,272 | B2 | 3/2007 | Yang et al. |
| 7,251,966 | B2 | 8/2007 | Fawcett et al. |
| 7,295,114 | B1 | 11/2007 | Drzaic et al. |
| 7,400,254 | B2 | 7/2008 | Yang et al. |
| D578,030 | S | 10/2008 | Yang et al. |
| 7,474,222 | B2 | 1/2009 | Yang et al. |
| 7,481,086 | B2 | 1/2009 | Fawcett et al. |
| 7,497,100 | B2 | 3/2009 | Fawcett et al. |
| 7,497,101 | B2 | 3/2009 | Fawcett et al. |
| D599,242 | S | 9/2009 | Yang |
| 7,671,741 | B2 | 3/2010 | Lax et al. |
| 2009/0058659 | A1 | 3/2009 | Handyside et al. |
| 2010/0171621 | A1* | 7/2010 | Yang ..... 340/572.9 |
| 2011/0115632 | A1* | 5/2011 | Yang ..... 340/572.8 |

* cited by examiner

*Primary Examiner* — Travis Hunnings
(74) *Attorney, Agent, or Firm* — Waters Law Group, PLLC; Robert R. Waters; Brian W. Foxworthy

(57) ABSTRACT

An electronic article surveillance apparatus for monitoring large objects is comprised of a base, at least one segment of tape, and an electronics housing. The segment of tape has a least one electrically conductive element running the length of the tape. The base rests on an object to be monitored, and the housing releasably latches onto the base, while each tape segment wraps around the object with each end of tape segment being fixed between the base and housing. Electronics within the housing complete a circuit through each tape segment and monitor the tape segments for electrical continuity. If electrical continuity is lost, either by cutting a tape segment, or unauthorized unlatching of the housing, an alarm can be sounded by the electronics within the housing. The electronic housing may be disarmed by a remote device and delatched from the base. Both base and tape segments may have adhesive elements.

21 Claims, 12 Drawing Sheets

EAS TAG USING TAPE WITH CONDUCTIVE ELEMENT

CROSS REFERENCE TO RELATED APPLICATIONS

This application is a continuation in part application based on U.S. patent application Ser. No. 12/391,222 filed on Feb. 23, 2009, in turn claiming priority to U.S. Provisional Application 61/030,932, filed on Feb. 22, 2008, and U.S. Provisional Application 61/030,929 filed on Feb. 22, 2008. The entire disclosures contained in U.S. patent application Ser. No. 12/391,222, U.S. Provisional Application 61/030,932, and U.S. Provisional Application 61/030,929, including the attachments thereto are incorporated herein by reference.

FIELD OF INVENTION

The present application is generally related to an electronic article surveillance (EAS) tag, and more specifically, an EAS tag that uses ribbon or tape having a conductive element to attach to objects. For example, the ribbon with conductive element may wrap around a box or similar object. Also, the tag of the present application may be used with various electronic article surveillance (EAS) systems, including for example, an EAS system utilizing tags and deactivators featuring infrared communication for deactivation and alarming and featuring dynamic time based pass code modification and other tamper resistant features, and/or an EAS system using passive element technology.

SUMMARY OF EMBODIMENTS OF THE INVENTION

The present invention is for an electronic article surveillance tag having an electronics housing portion and a base portion which combine with tape or ribbon to attach to boxes or similarly large objects.

The base portion of the EAS tag may have an adhesive element on its back surface so that it will adhere to an object when it is placed on it. The top surface of the base of the EAS tag has retention pads located on it. These retention pads are located near the edge and are adapted for receiving the ends of the conductive tape. These pads may have some type of gripping feature such as teeth, serrations, or pins pointing up from their surface to enable the pads to snag the conductive tape. In some embodiments, the edges of the retention pads that are perpendicular to the edge of the EAS tag base have low profile rails along them. These low profile rails serve to guide and retain the conductive tape as the ends of the conductive tape are placed on the conductive pads. Also, in some embodiments, located in the top surface of the base of the EAS tags are latch pockets which are positioned and adapted to receive latching hooks present in the electronic housing portion of the EAS tag. These are what hold the assembly together. In other embodiments, a ball clutch mechanism and shaft are used to hold the assembly together.

In some embodiments, the bottom of the electronic housing portion of the EAS tag has a set of conductive fields on its surface. These conductive fields are located and sized to lay over the retention pads in the base of the EAS tag. These conductive fields are comprised of strips of conductive material with spacing between them and oriented to cross the conductive element on the tape. There is also an electrical contact in proximity to each conductive field or even among each conductive field. This electrical contact is connected to a circuit board or microprocessor within the electronic housing of the EAS tag and along with a respective electrical contact creates a circuit with a section of tape. Opposing electrical contacts will thereby create an electrical circuit with a strip of tape with conductive element, and when two pieces of tape are used two circuits will be created. If either of these strips of tape is cut, the conductive element in the tape will be cut, and this will create an open circuit which can be detected by the electronics in the electronic housing portion of the EAS tag. The electronic housing portion of the EAS tag also has a limit switch protruding from its bottom surface. This limit switch detects when the electronic housing portion of the EAS tag has been placed on the base of the EAS tag. As referenced above, in some embodiments, the electronic housing portion of the EAS tag has latching hooks extending from its bottom surface. These latching hooks are positioned and arranged to engage the latch pockets of the base portion and release buttons around the edges of the electronic housing portion allow these latches to be disengaged so that the electronic housing portion may be removed from the base. Other embodiments employ a ball clutch mechanism and shaft.

The electronic housing portion of the EAS tag has several components within it, which may include: a microprocessor, a circuit board, a battery, an EAS core and coil element, the limit switch referenced above, an audible alarm producing device, an infrared communication port, and a light emitting diode. The microprocessor or circuit board can detect when the limit switch is depressed and when circuits are created on its electrical contacts to determine that the electrical housing portion of the EAS tag has been joined with a base portion, the base portion having tape spanning the sets of retention pads on its top surface. In that condition, the EAS tag may be armed with an arming device that communicates with the tag via the infrared communication port.

BRIEF DESCRIPTION OF DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS OF THE INVENTION

Figure 1:
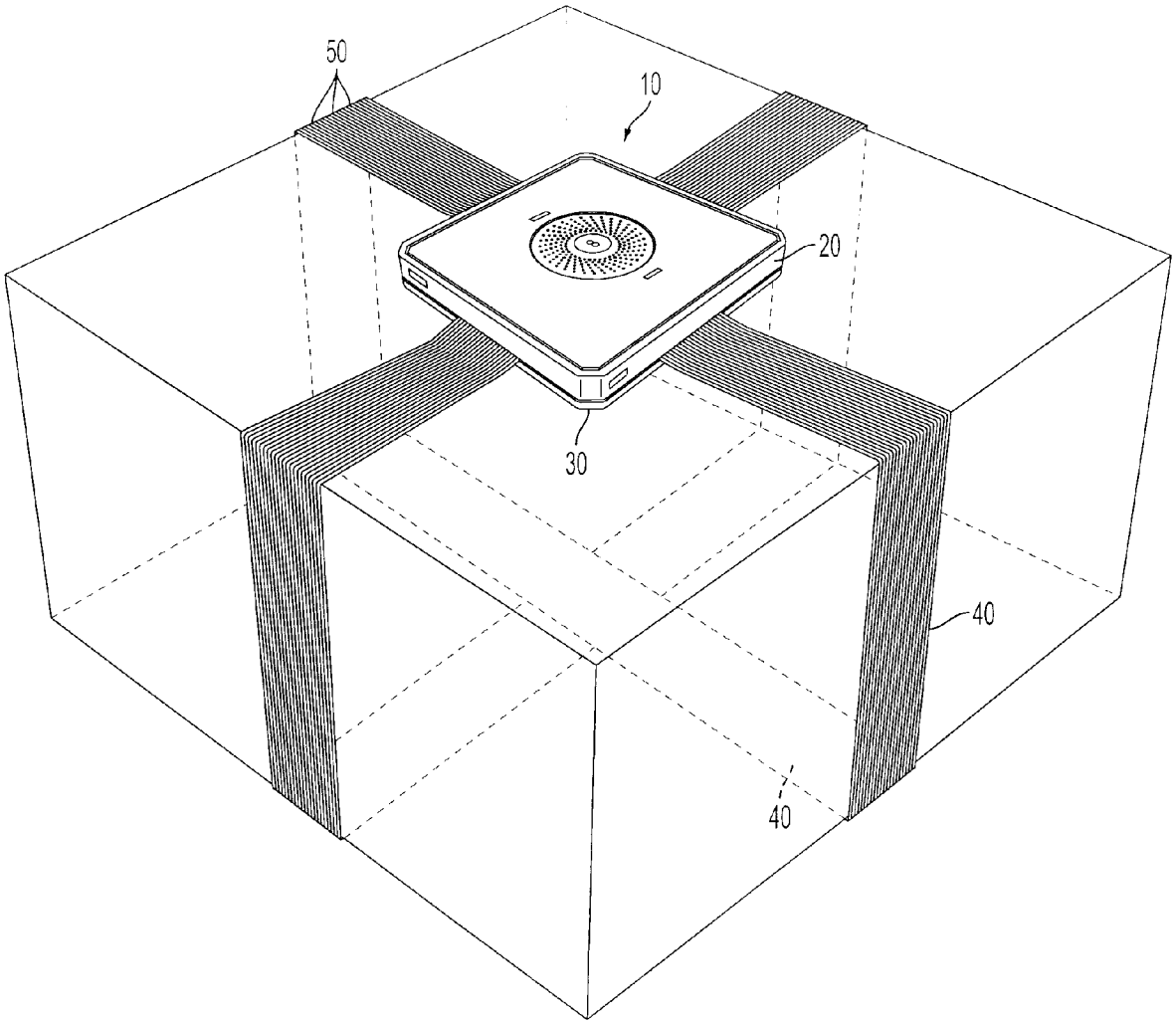
FIG. 1 shows an embodiment of an EAS tag of the present invention affixed to a box.

FIG. 1 shows an embodiment of an EAS tag 10 of the current invention. EAS tag 10 has a housing portion 20, a base portion 30, and tape, or ribbon, portion 40. The tape portion 40 wraps around an object, such as a box, that is to be protected and joins with the housing portion 20 and base portion 30. Tape, or ribbon, portion 40 has at least one conductive element 50 running along its length. In the embodiment shown in FIG. 1, the at least one conductive elements 50 is shown as the several stripes running the length of tape segments 40.

Figure 5:
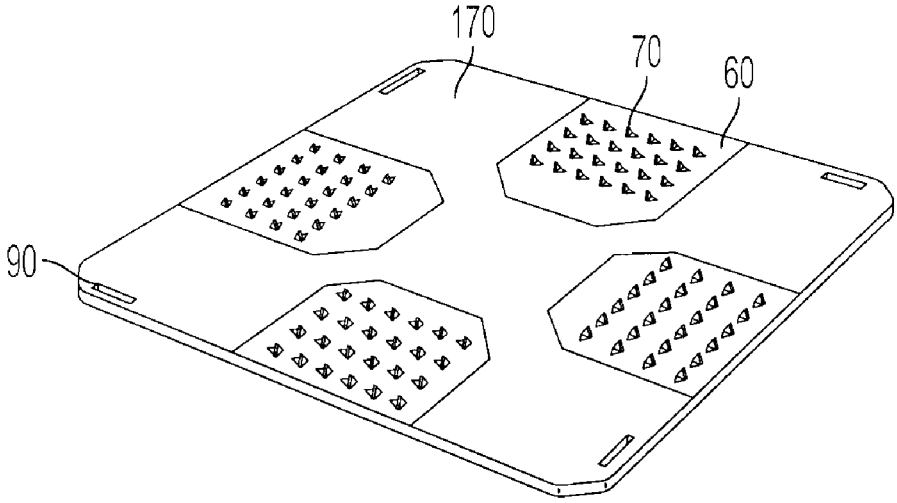
FIG. 5 shows the top of an embodiment of the base for the EAS tag.
Figure 6:
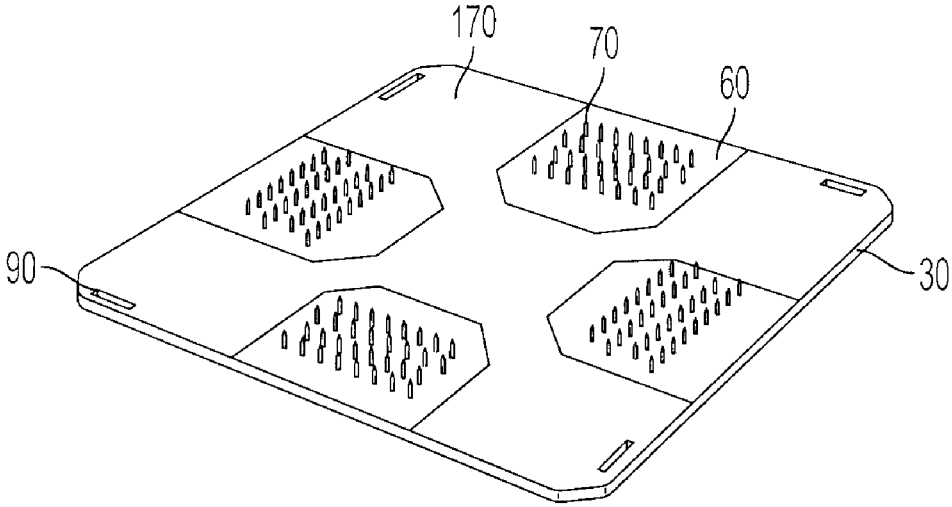
FIG. 6 shows the top of another embodiment of the base portion of the EAS tag.

Referring now to FIGS. 5 and 6, which show embodiments of base portion 30 of EAS tag 10, base portion 30 has at least one retention pad 60. In FIGS. 5 and 6, base portion 30 has four retention pads 60. This allows base portion 30 shown in FIG. 5 and FIG. 6 to accommodate two lengths of tape 40 without having the ends of the segments of tape 40 overlap. In FIGS. 5 and 6, retention pads 60 have snags 70 to engage tape 40. Snags 70 may be perforations stamp out of retention pads 70, needles attached to or formed from retention pads 70, or even formed from base 30 in which latter case the area of snags 70 would define retention pads 60.

Figure 2:
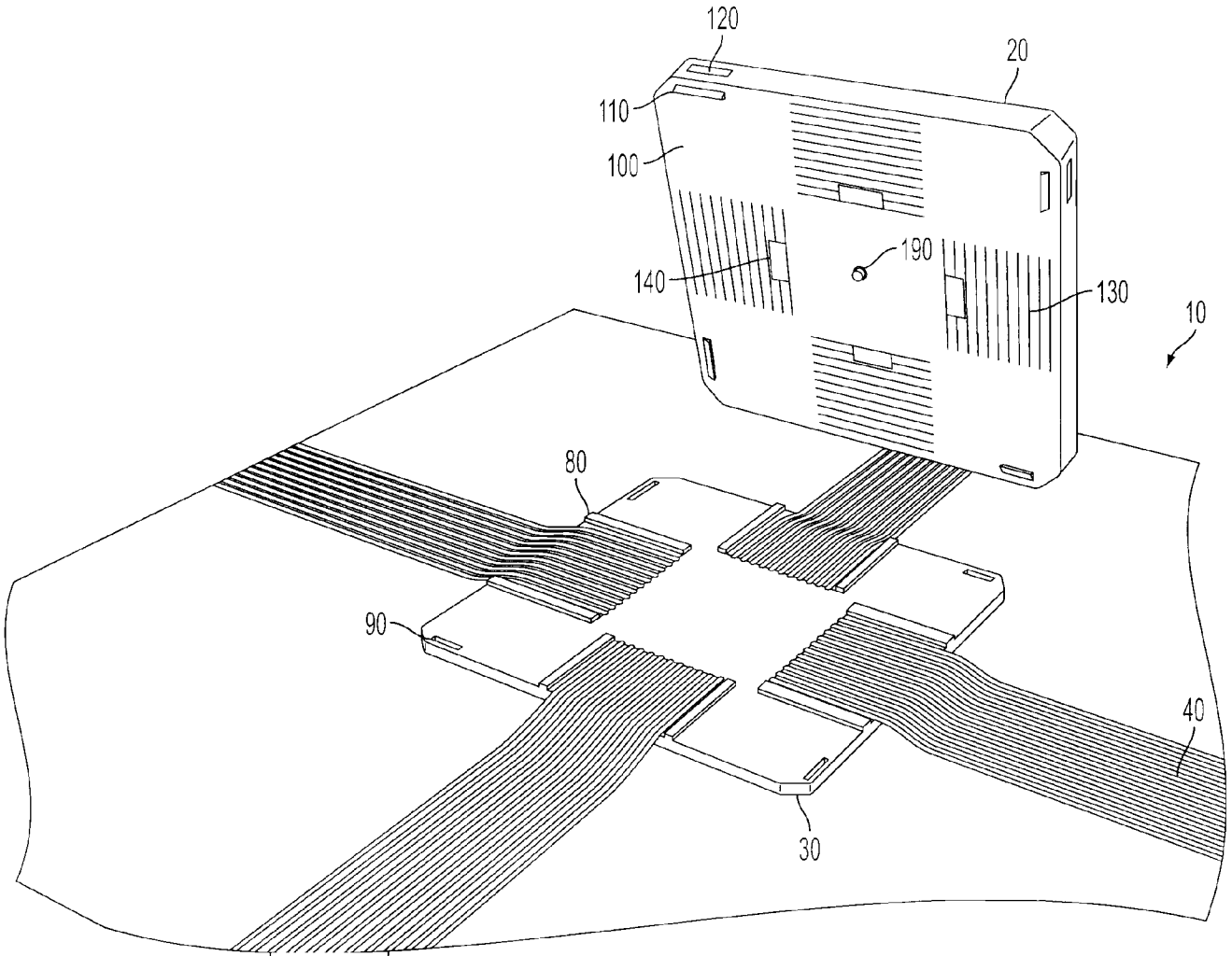
FIG. 2 shows an embodiment of the present invention with its top portion removed.

Referring now to FIG. 2, EAS tag 10 is shown with housing 20 removed from base portion 30 and tape segments 40 which are in place on an object to be monitored. In FIG. 2, retention pads 60 are not visible as they are covered by the ends of segments of tape 40. However, tape guides 80 may be seen raised from the top surface of base portion 30 of EAS tag 10. Tape guides 80 facilitate the accurate placement of the ends of segments of tape 40 on retention pads 60 which are visible in FIGS. 5 and 6 as previously discussed. Tape guides 80 may be formed from retention pads 60 or formed from base 20. The segments of tape 40 in FIG. 2 do not overlap at their ends as tag 10 is installed. Also located on the top surface of base portion 30 are latch pockets 90. Latch pockets 90 in base portion 30 cooperate with elements in housing portion 20 to retain housing portion 20 to base portion 30 when EAS tag 10 is fully assembled. In the embodiment of EAS tag 10 shown in FIG. 2, conductive elements 50 are exposed on the top surface of tape segments 40.

In FIG. 2, housing portion 20 is shown removed from base portion 30 and turned to display the bottom surface 100 of housing 20. Latch tabs 110 may be seen extending from bottom surface 100 of housing portion 20. Latch tabs 110 are positioned to align with latch pockets 90 in the top surface of base portion 30. When housing portion 20 is assembled onto base portion 30 and tape segments 40, latch tabs 110 insert into latch pockets 90 and affix housing portion 20 onto base portion 30 and tape segments 40 to maintain EAS tag 10 in an assembled state. Around the sides of housing portion 20 of EAS tag 10 are located latch releases 120. Latch releases 120 allow latch tabs 110 to be disengaged from latch pockets 90 to remove housing portion 20 from base portion 30 of EAS tag 10.

On the bottom surface 100 of housing portion 20 of EAS tag 10 are located contact fields 130. In the embodiment of EAS tag 10 shown in FIG. 2, contact fields 130 are comprised of several independent conducting strips oriented generally perpendicular to the conducting elements 50 in tape segments 40. The independent conducting strips of contact fields 130 serve to bridge conducting elements 50 on tape segments 40 to create electrical paths among the several conducting elements 50 on tape segments 40. This provides a more general conductive path via tape segment 40 around an object to be protected. Electrical contacts 140 located on the bottom surface 100 of housing portion 20 have electrical continuity with a circuit board within housing 20 and make contact with tape 40. Contact fields 130 provide general conductivity through tape segments 40 while electrical contacts 140 complete a circuit from tape 40 to a circuit board within housing portion 20 to a respective electrical contact 140 and the respective end of tape segment 40. This provides at least one continuous circuit about an object to be protected and if a tape segment 40 is cut to remove EAS tag 10 without authorization, the circuit board can detect this and generate either an audible alarm or a system alarm. In the alternative, if housing portion 20 is removed from base portion 30 without authorization the circuit board can detect the loss of completed circuits through its contacts on the bottom surface 100 of housing 20 and also generate an alarm, either audible or system alarm. EAS tag 10 can generate a system alarm by communicating its change of status with the system via radio frequency communication from the electronics in housing 20 or other forms of communication.

Figure 4:
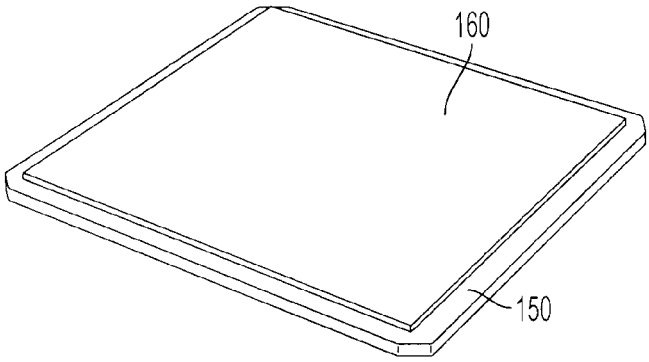
FIG. 4 shows the bottom of the base portion of an embodiment of an EAS tag.

FIG. 4 shows the bottom surface 150 of base portion 30. Bottom surface 150 of base portion 30 has an adhesive element 160 on it. Adhesive element 160 facilitates the assembly of EAS tag 10 on an item to be protected. Base portion 30 is placed on an item to be protected with adhesive elements 160 on the bottom surface 150 of base portion 30 contacting the object to place the top surface of base portion 30 in an exposed position. Then at least one tape segment 40 is wrapped around the object to be protected with each end of tape segment 40 being placed on retention pads 60 of bottom portion 30 to be engaged by snags 70 on retention pads 60. If desired, a second tape segment 40 may be wrapped around the object to be protected in a different direction and additional retention pads 60 engaged by that additional tape segment 40. Once base portion 30 and tape segments 40 are satisfactorily installed on an object desired to be protected, as shown in FIG. 2, housing portion 20 may be installed on base portion 30. Adhesive elements 160 on bottom surface 150 of base portion 30 may be comprised of a pressure sensitive adhesive pad, a pre-applied contact adhesive, or may even be an adhesive applied at the time of use, such as a spray, paste, pressure sensitive adhesive pad, or other applicable adhesive.

Figure 3:
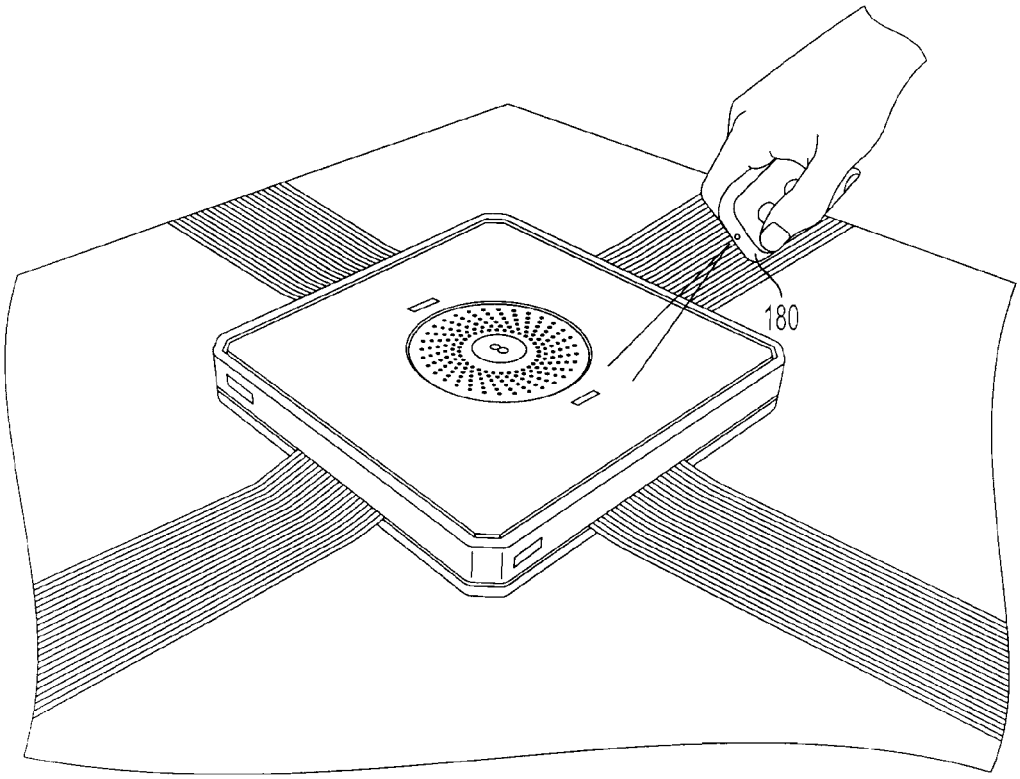
FIG. 3 shows an embodiment of the EAS tag of the current invention being disarmed with a remote device before being removed from a box.

When housing portion 20 is set upon base portion 30, contact fields 130 and electrical contacts 140 contact the conductive elements in tape segment 40 completing circuits through tape segments 40 and a circuit board within housing portion 20. These completed circuits set the condition for arming EAS tag 10 for an anti-theft function. FIG. 3 shows a hand held remote activating EAS tag 10. Hand held remote 180 may communicate with EAS tag 20 with any of several known methods. These methods may include infrared communication and radio frequency communication.

Referring to FIG. 2, limit switch 190 is located in the bottom surface 100 of housing portion 20. Limit switch 190 provides an alternative method to communicate to the circuit board in housing 20 that housing 20 has been engaged with base portion 30. When limit switch 190 is actuated, EAS tag 10 is again ready to be armed. At that time, a remote may be used to arm EAS tag 10 for security purposes. If housing portion 20 and base portion 30 of EAS tag 10 are separated, actuating limit switch 190, or if tape segments 40 are cut, opening circuits including tape segments 40, then EAS tag 10 will alarm either audibly or with a system alarm.

Figure 7:
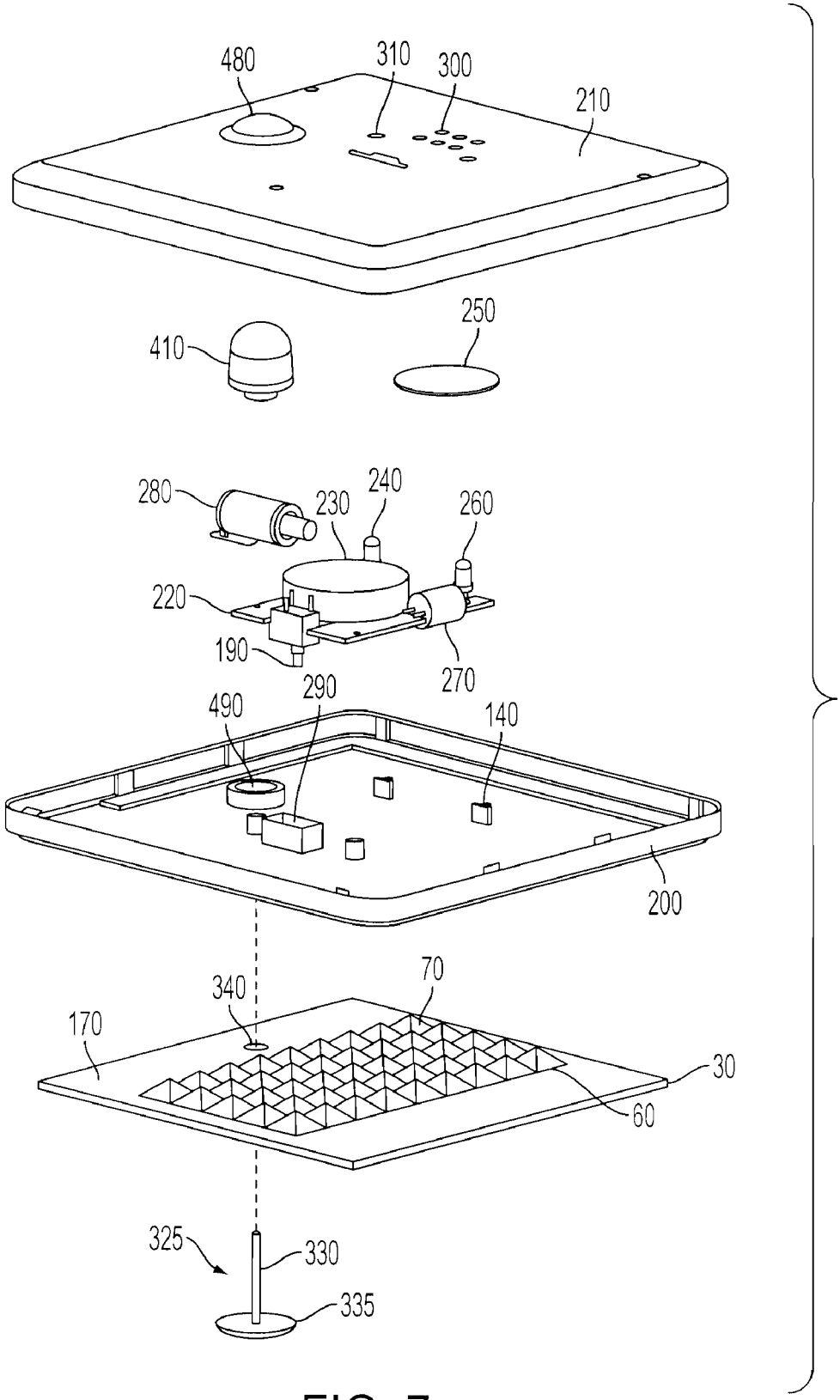
FIG. 7 is an exploded view of the housing portion and base portion of an embodiment of an EAS tag of the current invention.

FIG. 7 shows an exploded view of housing portion 20 separated from an embodiment of bottom portion 30. The embodiment of housing portion 20 shown in FIG. 7 is made from a bottom tray 200 and an upper cover 210. Together, tray 200 and upper cover 210 form the body of housing portion 20 of EAS tag 10. Housing portion 20 carries the electronic components of EAS tag 10. The electronic components may comprise a circuit board 220, a microprocessor 230, an infrared communication port 240, an audible alarm generator 250, a light emitting diode 260, a battery 270, limit switch 190, and a passive electronic article surveillance element 280 such as a core and coil electronic article surveillance element. Other embodiments may use a magnetorestrictive resonator as a passive element.

Circuit board 220 and microprocessor 230 are programmable to monitor the status of EAS tag 10 and to communicate with remote programmers and other elements of an EAS system. Circuit board 220 and microprocessor 230 may be reprogrammed via communication with hand held remotes or other elements of EAS system when communicating with these devices. In the embodiment shown in FIG. 7, circuit board 220 and microprocessor 230 can communicate via infrared communication port 240 and also receive programming instructions. Audible alarm generator 250 is capable of generating an audible alarm when EAS tag 10 is tampered with, for examples, in an attempted forced separation of housing 20 and base 30 or by the cutting of a section of tape 40. Audible alarm generator 250 may also be used to indicate the status of EAS tag 10 as it is assembled, for examples, when circuits are completed via tape segments 40, or when limit switch 190 has been actuated through assembly of housing portion 20 and base portion 30. Similarly, LED 260 can be used to provide visual cues for the status of EAS tag 10. Battery 270 generally provides power for the electronic components of EAS tag 10. EAS element 280 is a passive element compatible with prior art EAS systems. These EAS systems generate what is called an interrogation field at a given frequency. These interrogation fields will build up a small amount of stored energy on passive EAS elements brought into the zone. When the interrogation field is turned off and the EAS system listens for a response, the passive EAS elements dissipate their energy and generate a signal at a designed frequency. The EAS system is capable of detecting the signal as indication of the unauthorized presence of the passive elements and can generate an alarm based on the signal. The EAS elements 280 contained within the embodiment of EAS tag 10 in FIG. 7 is compatible with prior art and legacy systems providing an addition security mechanism. In addition to the prior art system detection of the passive EAS element 280, in some embodiments circuit board 220 and microprocessor 230 can monitor the status of passive element 280 and issue an alarm as well. If microprocessor 230 or circuit board 220 detects energy storage and dissipation activity in the coil, then audible alarm generator 250 may be instructed to generate an alarm or the communication capabilities of the circuit board may be employed to communicate with the broader EAS system to generate an alarm.

Tray 200 and cover 210 provide the necessary apertures for the electronic components of EAS tag 10 to communicate with its environment. Tray 200 provides limit switch aperture 290 for limit switch 190 while electrical contacts 140 are visible in tray 200. Electrical contacts 140 provide electrical continuity between circuit board 220 and tape segments 40 as shown in FIG. 2. Cover 210 has sound apertures 300 and light apertures 310. Sound apertures 300 allow audible alarms generated by audible alarm generator 250 easier escape to the surroundings, while light apertures 310 are generally aligned with infra red communication port 240 and LED 260 to allow direct line of sight communication via those elements. Light apertures 310 may or may not have some type of translucent covering over them.

FIG. 7 shows an embodiment of base 30 having a single retention pad 60 covering an extensive part of top surface 170 of base 30. Snags 70 in retention pad 60 may be molded features of base portion 30. The increased size of retention pad 60 in the embodiment shown in FIG. 7 assist with ease of assembly of EAS tag 10 for deployment.

FIG. 7 shows an embodiment of EAS tag 10 that uses a shaft and ball clutch mechanism 410 to latch housing portion 20 and base portion 30 together. Base portion 30 has a shaft aperture 340 through it. Tack 325 has a shaft 330 and head 335. Shaft 330 of tack 325 is inserted through shaft aperture 340 in base portion 30 and into a shaft aperture in housing 20 to engage ball clutch mechanism 410 and latch housing portion 20 to base portion 30.

Figure 8:
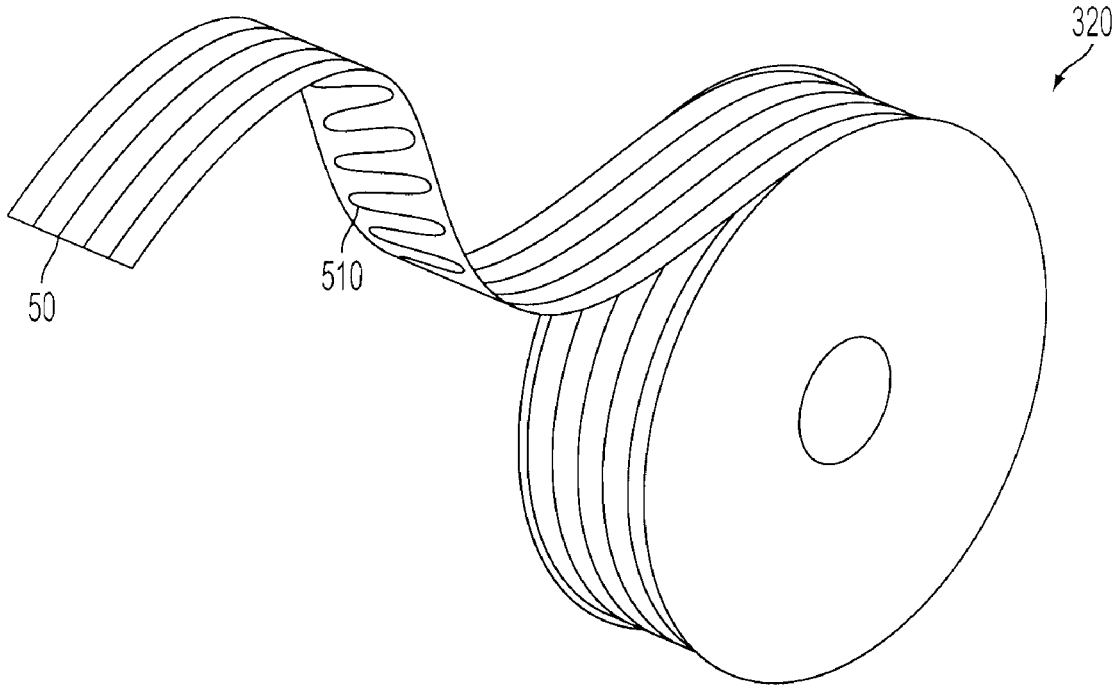
FIG. 8 shows a roll of tape from which segments of tape for embodiments of the present invention may be cut or ton.

FIG. 8 shows a roll 320 of tape having a conductive element 50. As shown in FIG. 8 the tape is elongated, may be packaged as rolls, and has at least one conductive element 50 running along its length. This conductive element 50 may be comprised of several elongated electrically conductive strips exposed on at least one surface of the tape. Additionally, an adhesive element 510 may be present on either the top or bottom surfaces of the tape, or both. Although several embodiments of retention pads 60 employ snags 70 to strongly engage tape segments 40, an adhesive element 510 would facilitate the retention of tape segments 40 and some embodiments employ it. Adhesive on the tape also facilitates the assembly of EAS tag 10 to an object to be protected by providing strong retention of tape segments 40 to the object itself providing greater stability and control while the elements of EAS tag 10 are assembled on the object.

Figure 9:
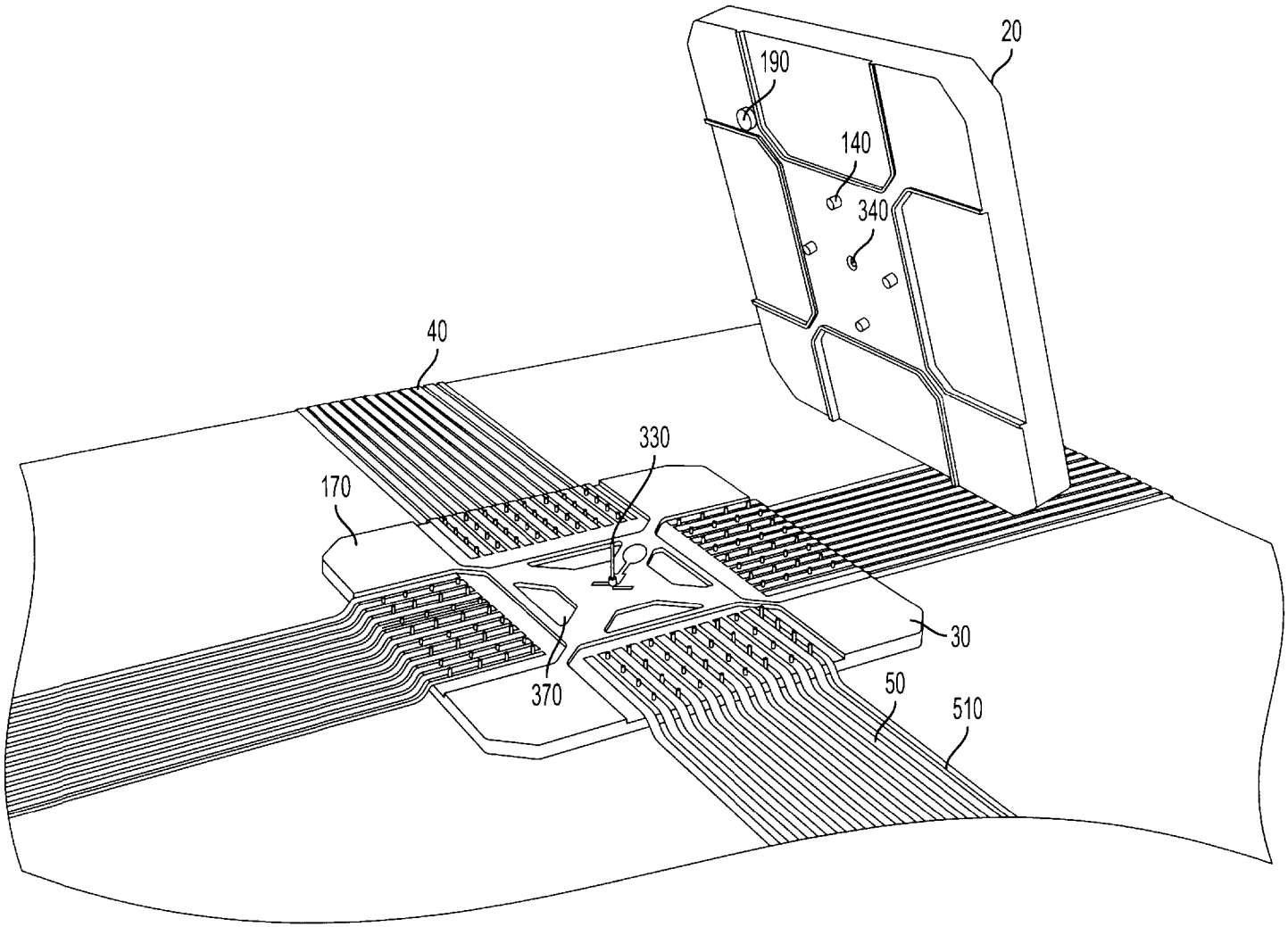
FIG. 9 shows an additional embodiment of the current invention with the top housing portion lifted from the tape segments and base portion.
Figure 10:
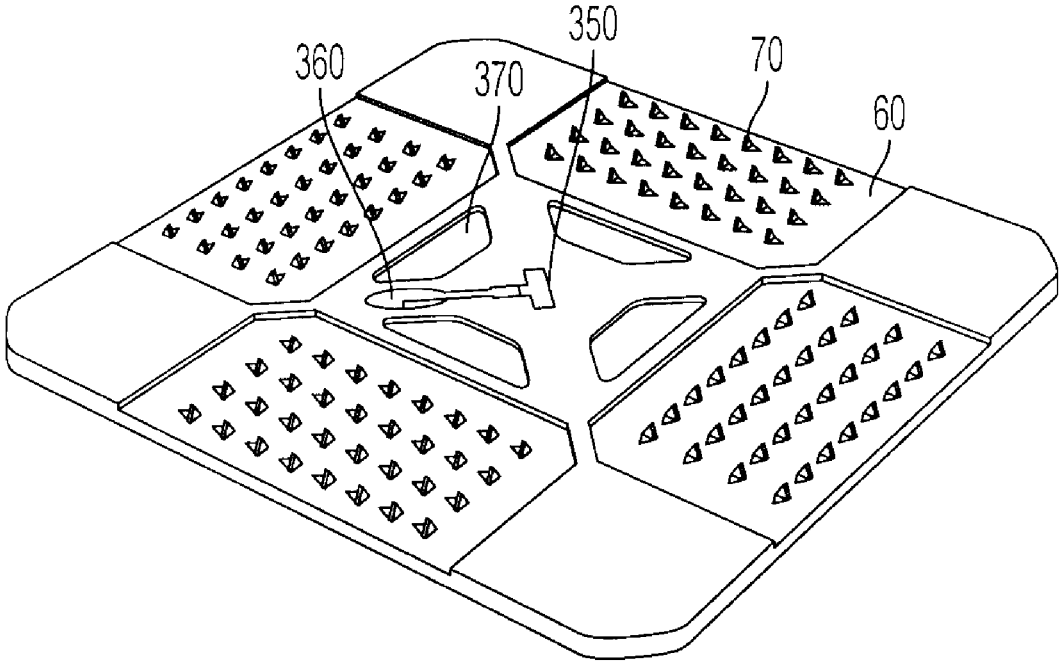
FIG. 10 shows the base portion of the embodiment of FIG. 9.

FIG. 9 shows an embodiment of EAS tag 10 that uses a shaft and ball clutch latching mechanism to maintain housing portion 20, base 30, and tape segments 40 assembled. When EAS tag 10 is being assembled, base portion 30 is placed on the object to be monitored, tape segments 40 are placed around the object to be monitored and the ends of the tape segments 40 are placed on retention pads 60 and then housing 20 is placed on base 30. With the placement of housing 20 on base 30, shaft 330 is inserted into shaft aperture 340 where a ball clutch mechanism is located. The ball clutch mechanism is known in the art but will be discussed in more detail below. Shaft 330 is mounted on a pivot 350 which allows shaft 330 to fold down into shaft pocket 360 in base portion 30. When EAS tag 10 is not assembled and top surface 170 of base portion 30 is therefore exposed, the ability of shaft 330 to fold into base portion 30 prevents shaft 330 from being damaged before base portion 30 is used and also prevents shaft 330 from protruding from base portion 30 and presenting a safety hazard. FIG. 10 shows shaft 330 pivoted down into shaft pocket 360.

FIG. 10 presents an unobstructed view of base portion 30. As before, base portion 30 has a set of retention pads 60 with snags 70. In the embodiment of FIG. 10, retention pads 60 and snags 70 are themselves made of a conductive material. When the ends of tape segments 40 are placed on retention pads 60 and engaged by snags 70, electrical connections are established between retention pads 60 and snags 70 and the conductive element of tape segment 40. Adjacent to retention pads 60 in base portion 30 are retention pad contacts 370. Retention pad contacts 370 provide an electrical contact surface between retention pads 60 and housing 20. Retention pad contacts 370 may be discrete contacts having an electrical connection to retention pads 60 or they may merely be extensions of retention pads 60. Referring back to FIG. 9, the bottom surface of housing 20 is visible. Electrical contacts 140 extend from the bottom surface of the housing 20 and are arranged and aligned to contact retention pad contacts 370 when housing 20 is assembled onto base 30. When base 30 is placed on an object, at least one tape segment 40 is wrapped around the object with each end engaging opposite retention pads 60, and housing 20 is assembled onto base 30 and tape segments 40, an electrical circuit is completed through tape segment 40 at one end to a respective electrical contact 140 to a circuit board within housing 20 back out a respective opposing electrical contact 140 to an opposing retention pad contact which completes the circuit with the opposite end of the tape segment 40. This completed circuit provides a means for monitoring both the integrity of tape segments 40 and the retained position of housing 20 on plate 30. If a tape segment 40 is cut, then a circuit is opened and the microprocessor and circuit board present within housing 20 can detect the open circuit and an alarm may be sounded. Alternatively, if housing 20 is disassembled from base 30 and tape segments 40 by an unauthorized person, then the circuits are again opened and a circuit board and microprocessor within housing 20 can detect the open circuit and sound an alarm.

Alternatively, limit switch 190 on the bottom of housing 20 may be used to monitor the status of EAS tag 10. When housing 20 is assembled to base 30, limit switch 190 is actuated, informing the circuit board and microprocessor of the status of the tag. Unauthorized separation of housing 20 from base 30 changes the status of limit switch 190 and the electronics of housing 20 will detect this and respond as programmed.

Implicit in the discussion of the embodiment of FIG. 9 is electrical conductivity between the bottom surface of tape segments 40 and retention pads 60. This requires that the conductive element of tape segments 40 be on the bottom surface of tape segments 40 or at least accessible to retention pads 60. This may be accomplished by having the general substrate of tape segment 40 being electrically conductive or it may require the conductive element of tape segment 40 being exposed on the surface of the general substrate of tape segment 40. Alternatively, electrical conductivity could be accomplished by snags 70 on retention pads 60 piercing tape segments 40 and passing through tape segment 40 in various places. In those embodiments, the conducting elements of tape segment 40 could be on the bottom surface, encapsulated in the substrate, or even on the top surface providing that snags 70 pierce through the top surface sufficiently to create electrical continuity. Additionally, tape segments 40 of the embodiment shown in FIG. 9 may have an adhesive element as well. This adhesive element may run the length of tape segment 40 or may occur in distinct locals on tape segments 40 and the adhesive element may occur on both surfaces and only one when an adhesive element is present.

Figure 11:
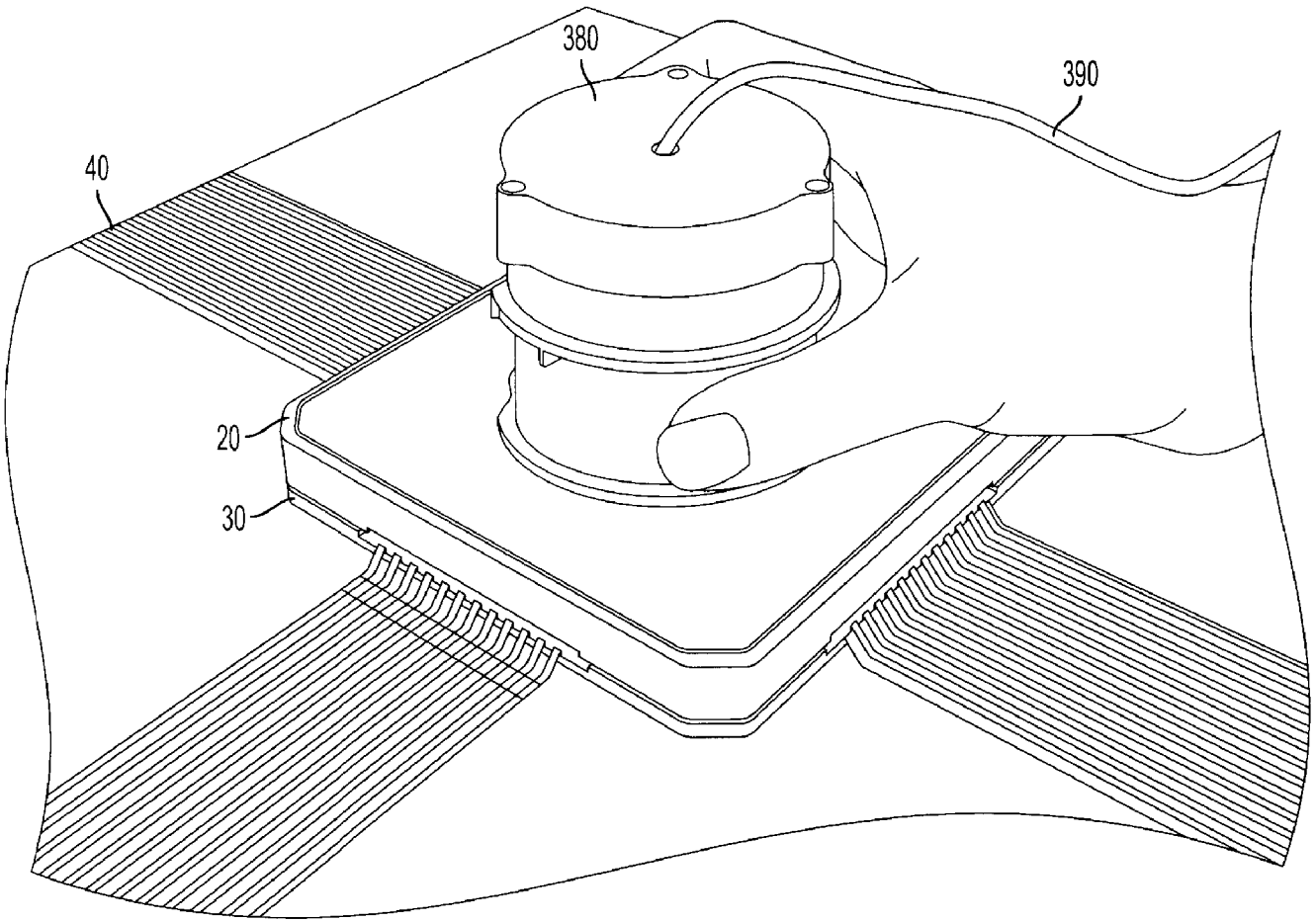
FIG. 11 shows an EAS tag of the present invention being deactivated and the housing portion released from the base portion.

FIG. 11 shows EAS tag 10 in the process of being deactivated and disassembled from an object being secured by EAS tag 10. Hand held detacher 380 is placed on EAS tag 10 to release housing 20 from base 30. A strong magnet within detacher 380 actuates a latching mechanism within housing 20 to release shaft 330 and allow housing 20 to be lifted. Detacher 380 may also have an infrared communication port which is capable of communicating with an infrared communication port in housing 20. This infrared communication allows detacher 380 to communicate with housing 20 and disarm it before housing 20 is lifted from base 30. Alternatively, radio frequency communication may be used. Once the electronics of housing 20 are disarmed, housing 20 may be lifted from base 30 which will change the status of limit switch 190 and open circuits through tape segments 40, without housing 20 generating an alarm. In some embodiments, detacher 380 and housing 20 will exchange an encrypted password to offer a further level of security. Detacher 380 may be powered by a cable 390 connected to an element within the EAS system, or detacher 380 may simply be tethered to another object to prevent it from being mislaid or stolen.

Figure 12:
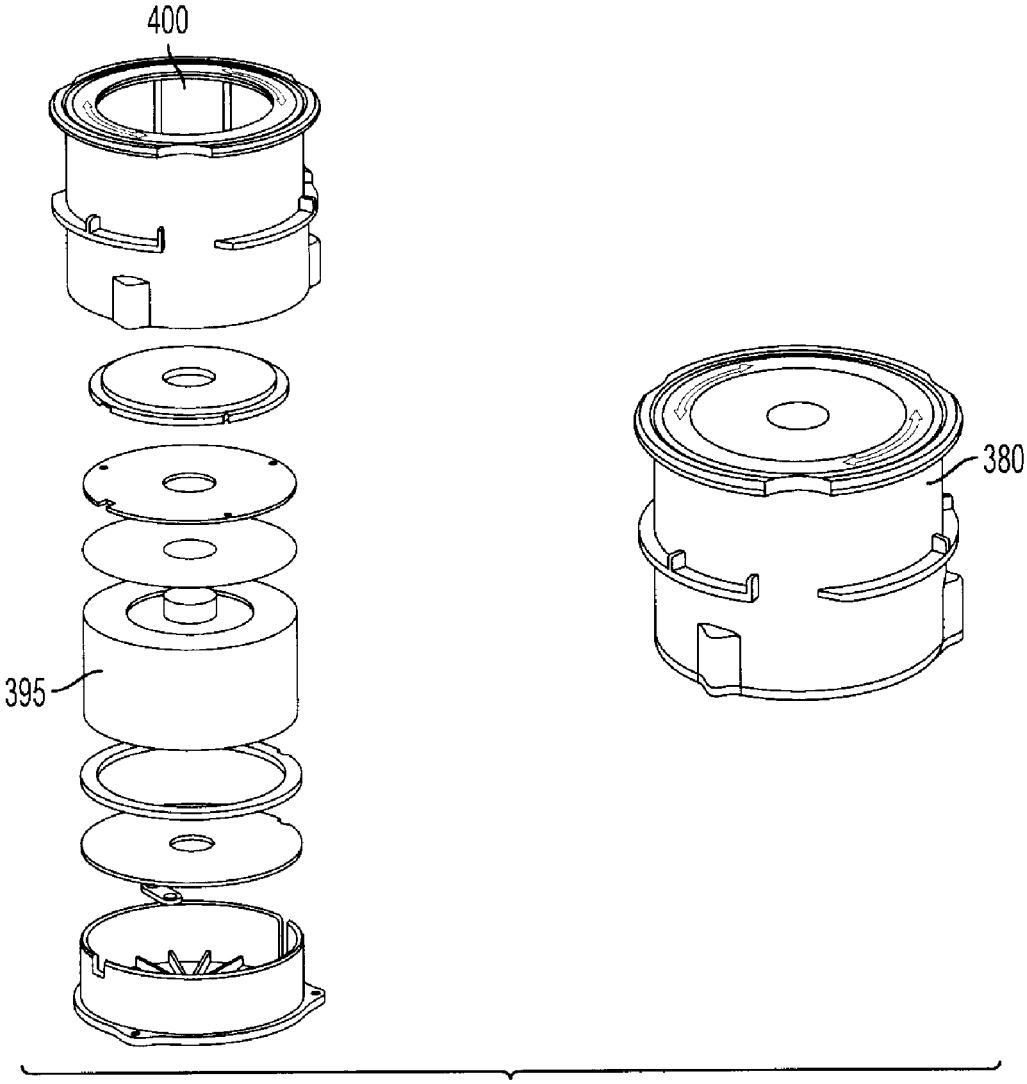
FIG. 12 shows a detacher that may be used with embodiments of the EAS tag of the present invention to activate, deactivate, and detach the various embodiments.
Figure 13:
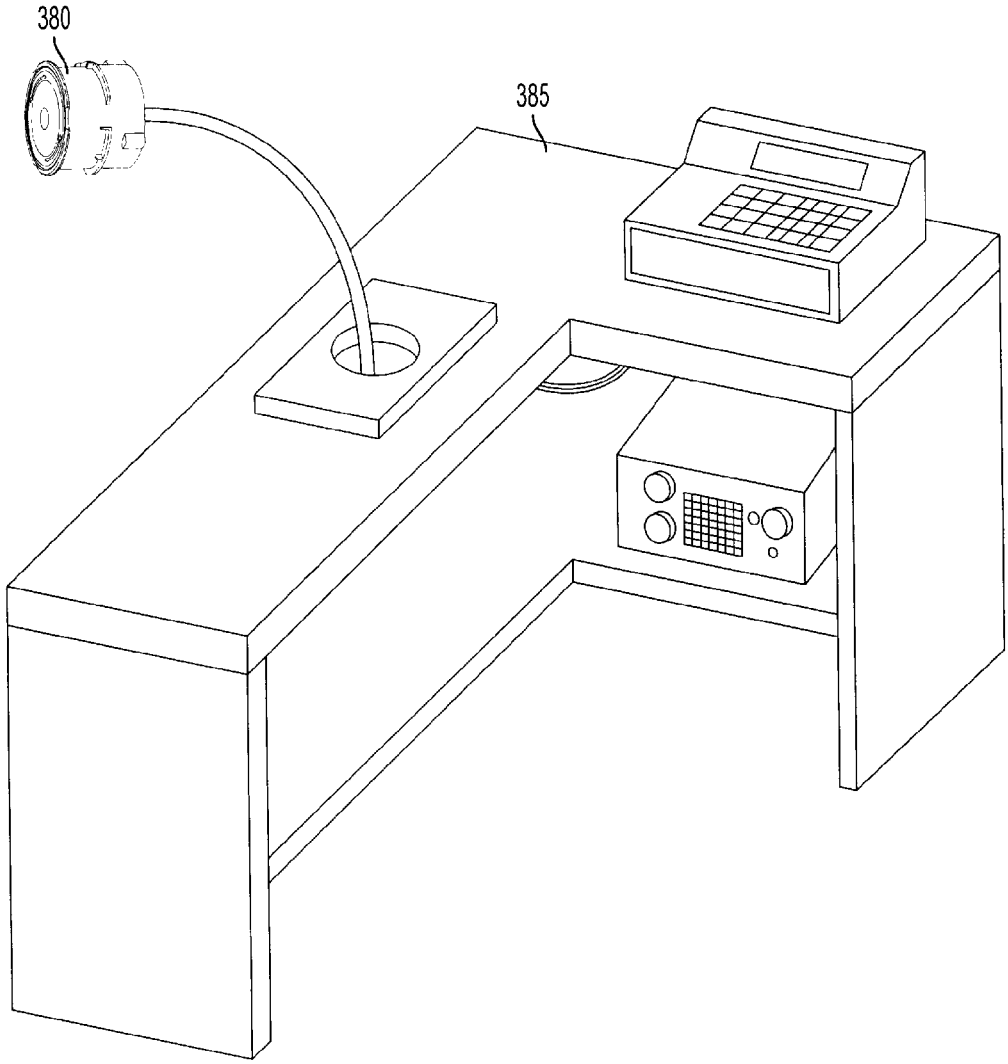
FIG. 13 shows the detacher of FIG. 12 in a retail location.

FIG. 12 shows an exploded view of detacher 380. Detacher 380 has a strong magnet 395 and an infrared communication port 400 for communicating with some embodiments of EAS tag 10 of the present invention. Strong magnet 395 in detacher 380 can actuate a ball clutch mechanism, or other magnetically activated latching mechanism, to allow housing 20 to be separated from base 30. Infrared communication port 400 allows detacher 380 to program or disarm EAS tag 10 in those embodiments employing infrared communication. FIG. 13 shows detacher 380 removed from its mount in a retail counter 385. In situations where the object being protected by EAS tag 10 is too large to be placed on a counter, detacher 380 may be extended from its typical position to be applied to the object and detach EAS tag 10.

Figure 14:
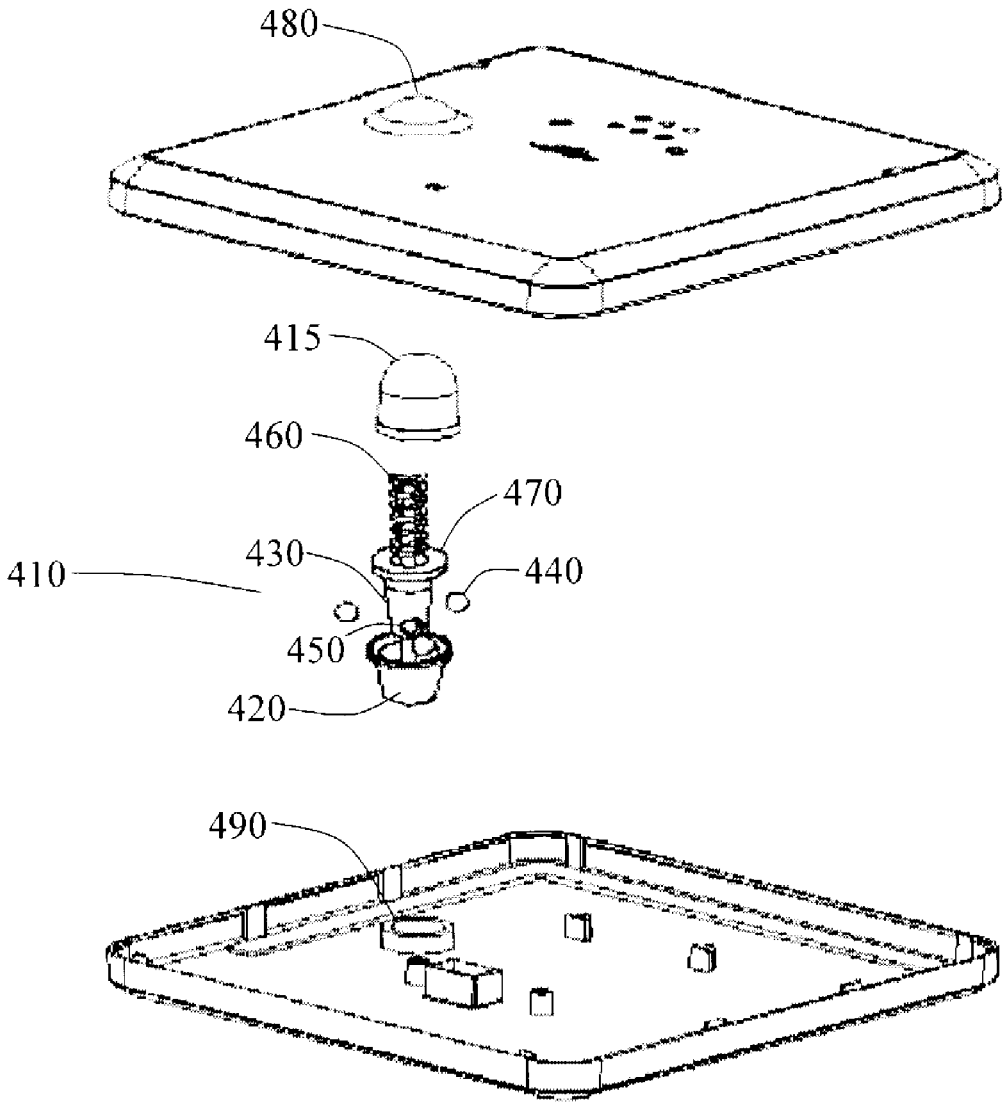
FIG. 14 shows an exploded view of the ball clutch mechanism present in the housing portion of some embodiment of the EAS tag of the current invention.

FIG. 14 shows an exploded view of a ball clutch mechanism 410 above a clutch seat 490 and shaft aperture in housing 20 of EAS tag 10. Ball clutch mechanism 410 is comprised of clutch housing 415, cup 420, spindle 430, balls 450, and spindle spring 460. When ball clutch mechanism 410 is assembled, clutch housing 415 contains the other elements of ball clutch mechanism 410. CUP 420 is slightly conical in shape and open at the large end of the cone. It is closed at the smaller end of the cone but has an aperture through the closed end. Spindle 430 is generally round and sized and shaped to seat within cup 420, is hollow along its axis, and has ball apertures, typically three, from its outer surface to its hollow central axis. Spindle 430 also has a spring seat around its circumference on the end opposing cup 420. Spring 460 sets on spring seat 470. Balls 440 are located in ball apertures 450 and the assembly of spindle 430 and balls 440 rest in cup 420. Ball clutch mechanism 410 sets on clutch seat 490 when assembled.

Referring now to FIGS. 7, 9, and 14, when housing 20 is assembled to base 30, shaft 330 inserts through shaft aperture 340 and into cup 420 and spindle 430. This pushes spindle 430 up slightly along with balls 440 around the periphery of spindle 430. Balls 440 encircle shaft 330 and spindle spring 460 biases spindle 430 down into cup 420 to maintain contact between cup 420, balls 440, and shaft 330 so that if an attempt is made to withdraw shaft 330, balls 440, shaft 330, and cortical cup 420 create a wedging action preventing shaft 330 from being withdrawn. Spindle 430 is made at least partially of a magnetically attractable material. Spring 460 generally biases spindle 430 into cup 420. To release shaft 330 from ball clutch mechanism 410, a strong magnet is applied above spindle 430 in ball clutch mechanism 410. The magnetically attractable spindle 430 is pulled up out of cup 420, overcoming spring 460, and balls 440 are moved up into an area of cup 420 where space is available between balls 420 and shaft 330. This allows shaft 330 to be withdrawn from ball clutch mechanism 410. With the prior disarming of EAS tag 10, housing 20 may be separated from base 30 without triggering an audible alarm, or a system alarm. Other latching mechanisms may also be employed in other embodiments of the EAS tag.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. An electronic article surveillance apparatus comprising:

a base portion, said base portion having a top surface, and a bottom surface, said top surface of said base portion having at least one retention pad and at least one set of two latch pockets;

at least one section of tape, said section of tape having a top surface and a bottom surface and a first end and a second end and being sufficiently long to pass around an object to be monitored with both said first end and said second end being positioned on said base portion, and said at least one section of tape having at least one conductive element, said at least one conductive element running the length of said at least one section of tape, and;

a housing portion housing electronic components, said housing portion having a bottom surface, a top surface and at least one side connecting said bottom surface and said top surface;

said bottom surface of said housing portion having at least one set of at least two latch tabs extending from it, and at least one set of two electrical contacts, each said electrical contact having electrical continuity with the interior of said housing portion and positioned to make contact with said at least one conductive element of said segment of tape, and each said latch tab being located to insert into a respective latch pocket and be releasable retained in said top surface of said base portion when said housing portion is set on said base portion;

said electronic components in said housing portion completing electrical continuity within each set of electrical contacts.

2. The electronic article surveillance apparatus of claim 1, wherein:

said bottom surface of said base portion has an adhesive element.

3. The electronic article surveillance apparatus of claim 1, wherein:

each of said at least one retention pad is comprised of an electrically conductive material.

4. The electronic article surveillance apparatus of claim 1, wherein:

said at least one retention pad has snags to better enable retention of said tape.

5. The electronic article surveillance apparatus of claim 1, wherein:

said at least one section of tape comprises an adhesive element on at least one side.

6. The electronic article surveillance apparatus of claim 1, wherein:

said at least one section of tape is produced from a roll of tape having at least one conductive element running the length of said tape.

7. The electronic article surveillance apparatus of claim 1, wherein:

said at least one conductive element is located on said top surface of said segment of tape.

8. The electronic article surveillance apparatus of claim 4, wherein:

said at least one conductive element is located on said bottom surface of said segment of tape.

9. The electronic article surveillance apparatus of claim 4, wherein:

said at least one conductive element is encapsulated between said top surface and said bottom surface of said segment of tape.

10. The electronic article surveillance apparatus of claim 1, further comprising:

at least one set of at least two contact fields on said bottom surface of said housing portion, each of said contact fields being positioned to individually contact one end of a said segment of tape.

11. The electronic article surveillance apparatus of claim 1, wherein:

said electronic components comprise a circuit board, a microprocessor, an infra-red communication port, an audible alarm generator, and a battery.

12. The electronic article surveillance apparatus of claim 1, wherein:

said electronic components comprise a passive electronic article surveillance element.

13. An electronic article surveillance apparatus comprising:

a base portion, said base portion having a top surface and a bottom surface, said top surface of said base portion having at least one retention pad;

at least one latch shaft said at least one latch shaft extending from said top surface of said base portion;

at least one section of tape, said section of tape having a top surface and a bottom surface and a first end and a second end and being sufficiently long to pass around an object to be monitored with both said first end and said second end being positioned on said base portion, and said at least one section of tape having at least one conductive element, said at least one conductive element running the length of said at least one section of tape, and;

a housing portion housing electronic components and a shaft clutch, said housing portion having a bottom surface and a top surface;

said bottom surface of said housing portion having a latch shaft aperture aligned with said shaft clutch and at least one set of at least two electrical contacts, each said electrical contact having electrical continuity with the interior of said housing portion, and said electronic components in said housing portion completing electrical continuity within each set of electrical contacts.

14. The electronic article surveillance apparatus of claim 13, wherein:

said latch shaft is pivotally attached to said base portion.

15. The electronic article surveillance apparatus of claim 13, further comprising:

a latch tack, said latch tack comprising said latch shaft and a cap, wherein said base portion has a shaft aperture through it and said latch shaft of said latch tack is inserted through said shaft aperture to extend from said top surface of said base portion.

16. The electronic article surveillance apparatus of claim 13, wherein:

said shaft clutch is a ball clutch.

17. The electronic article surveillance apparatus of claim 13, wherein:

said at least one retention pad is comprised of an electrically conductive material.

18. The electronic article surveillance apparatus of claim 17, wherein:

said base portion further comprises a contact pad associated with each said retention pad each said contact pad having electrical continuity with its respective retention pad, and wherein each said electrical contact on said bottom surface of said housing portion makes contact with a contact pad.

19. The electronic article surveillance apparatus of claim 13, wherein:

said electronic components comprise a circuit board, a microprocessor, an infra-red communication port, an audible alarm generator, and a battery.

20. The electronic article surveillance apparatus of claim 13, wherein:

said electronic components comprise a passive electronic article surveillance element.

21. An electronic article surveillance apparatus comprising:

a base portion, said base portion having a top surface, a bottom surface, and a first portion of a latching mechanism;

at least one section of tape, said section of tape having a top surface and a bottom surface and a first end and a second end and being sufficiently long to pass around an object to be monitored with both said first end and said second end being positioned on said base portion, and said at least one section of tape having at least one conductive element, said at least one conductive element running the length of said at least one section of tape, and;

a housing portion housing electronic components and having a second portion of a latching mechanism, said housing portion having a bottom surface and a top surface;

said bottom surface of said housing portion having at least one set of at least two electrical contacts, each said electrical contact having electrical continuity with the interior of said housing portion, and said electronic components in said housing portion completing electrical continuity within each set of electrical contacts, wherein;

said first portion of said latching mechanism and said second portion of said latching mechanism releasably latch with each other to maintain said base portion, said at least one segment of tape, and said housing portion in contact with each other.

* * * * *